US007049532B2

(12) United States Patent
Kanazawa et al.

(10) Patent No.: US 7,049,532 B2
(45) Date of Patent: May 23, 2006

(54) ELECTRIC CONTACTS, ELECTRIC CONTACT APPARATUS AND METHOD FOR DETECTING ABRASION OF THE ELECTRIC CONTACTS

(75) Inventors: Yukio Kanazawa, Yokohama (JP); Tadashi Mori, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/921,209

(22) Filed: Aug. 19, 2004

(65) Prior Publication Data

US 2005/0040020 A1 Feb. 24, 2005

(30) Foreign Application Priority Data

Aug. 22, 2003 (JP) ..... 2003-298103

(51) Int. Cl.
*H01J 47/00* (2006.01)

(52) U.S. Cl. ..... 200/61.02

(58) Field of Classification Search ..... 200/61.02; 340/657, 687; 361/2, 8, 12, 115; 324/420–423

See application file for complete search history.

(56) References Cited

U.S. PATENT DOCUMENTS

| | | | | |
|---|---|---|---|---|
| 4,553,008 | A * | 11/1985 | Veverka et al. | 218/56 |
| 4,723,084 | A * | 2/1988 | Reynolds | 310/247 |
| 5,718,581 | A * | 2/1998 | Fernwood et al. | 433/88 |
| 5,870,182 | A * | 2/1999 | Abend et al. | 356/73 |
| 6,777,948 | B1 * | 8/2004 | Dominelli et al. | 324/455 |

FOREIGN PATENT DOCUMENTS

| | | |
|---|---|---|
| JP | 6-14501 | 1/1994 |
| JP | 10-241481 | 9/1998 |
| JP | 11-354341 | 12/1999 |

* cited by examiner

*Primary Examiner*—Michael Friedhofer
*Assistant Examiner*—Lisa Klaus
(74) *Attorney, Agent, or Firm*—Oblon, Spivak, McClelland, Maier & Neustadt, P.C.

(57) ABSTRACT

A pair of electric contacts include a pair of first units which are provided on the surfaces of the end sides of the electric contacts, and generate light having first characteristics at the time of opening and closing of the electric contacts, and a pair of second units which are covered with the first units, and generate light having second characteristics differing from the first characteristics when abrasion of the first units reaches abrasion detection positions due to opening and closing of the electric contacts.

19 Claims, 9 Drawing Sheets

| Element | Wavelength (nm) | Light intensity |
|---|---|---|
| Ga | 403.80 | 1000 |
| Pb | 405.78 | 2000 |
| Nb | 405.89 | 1000 |
| In | 410.18 | 2000 |
| Ga | 417.21 | 2000 |
| Rb | 420.19 | 2000 |
| Rb | 421.56 | 1000 |
| Cr | 425.43 | 5000 |
| Cr | 427.48 | 4000 |
| Cr | 428.97 | 3000 |
| Hg | 435.83 | 3000 |
| Fe | 438.35 | 1000 |
| Fe | 440.48 | 1000 |
| In | 451.13 | 5000 |
| Ba | 455.40 | 1000 |
| Cs | 455.54 | 2000 |
| Cs | 459.32 | 1000 |
| Sr | 460.73 | 1000 |
| Bi | 472.25 | 1000 |
| Re | 488.92 | 2000 |

ELECTRIC CONTACTS, ELECTRIC CONTACT APPARATUS AND METHOD FOR DETECTING ABRASION OF THE ELECTRIC CONTACTS

CROSS-REFERENCE TO RELATED APPLICATIONS

This application is based upon and claims the benefit of priority from prior Japanese Patent Application No. 2003-298103, filed Aug. 22, 2003, the entire contents of which are incorporated herein by reference.

BACKGROUND OF THE INVENTION

1. Field of the Invention

The present invention relates to electric contacts which perform an electrical opening and closing operation in an electric circuit, an electric contact apparatus, and a method for detecting abrasion of the electric contacts.

2. Description of the Related Art

In each of electric devices for a high voltage such as a circuit breaker, a disconnector and a switching device in a power station or a substation, electric contacts for opening and closing an electric circuit are provided.

In view of cost and the environment adaptation, the electric devices tend to be made more compact, and also the electric contacts tend to be made smaller.

On the other hand, as electric power demand increases, a power voltage and electric capacity of the electric devices increases. As a result, the current densities of the electric contacts made smaller increase.

In each of the electric devices, a breaking operation is repeated under a high voltage. Thus, part of the electric contacts is evaporated or abraded by an arc heat generated at the time of opening and closing of the electric contacts. In order to correctly operate the electric contacts, and improve the operating rate of each electric device, it is important to accurately gauge the limit of abrasion of the electric contacts.

Examples of the conventional apparatus or method for detecting abrasion of electric contacts are disclosed in Jpn. Pat. Appln. KOKAI Publications No. 6-14501, No. 10-241481 and No. 11-354341, which will be hereinafter referred as literatures 1, 2 and 3, respectively.

Literature 1 discloses a method in which a magnet is attached to a brush, and its magnetic change is detected.

Literatures 2 and 3 respectively disclose a technique in which a piezoelectric element is attached to electric contacts, and its voltage change is monitored, and a technique in which a vibration sensor or an acceleration sensor is attached to a switching device, and an abnormal vibration of a main body, etc. are detected.

In all literatures 1–3, a sensor or the like is provided close to the electric contacts, and variation of electrical or mechanical characteristics of the electric contacts is measured, and it is detected whether an abnormality has occurred or not, based on the result of measurement.

In the conventional apparatus or method for detecting abrasion of electric contacts, variation of the characteristics of the electric contacts which is caused by deformation or abrasion thereof is measured to indirectly detect whether an abnormality has occurred or not.

Accordingly, in the conventional apparatus or method, an abnormality of the electric contacts is detected after it occurs, i.e., it is not detected before it occurs. That is, although the conventional apparatus or method detects an abnormality at an early stage, it cannot detect an abnormality before it occurs. Furthermore, when abrasion of the electric contacts is detected by the conventional apparatus or method, it is necessary to detect indirect variation of the characteristics. Thus, there is a case where the number of malfunctioning of, e.g., a sensor, such as a disturbance of a magnetic field, is increased.

Accordingly, before occurrence of an abnormality, the conventional apparatus or method can hardly directly detect that abrasion of the electric contacts has reached the limit of abrasion.

BRIEF SUMMARY OF THE INVENTION

The present invention provides a pair of electric contacts which comprise a pair of first units which are provided on the surfaces of the end sides of the electric contacts, and generate light having first characteristics at the time of opening and closing of the electric contacts, and a pair of second units which are covered with the first units, and generate light having second characteristics differing from the first characteristics when abrasion of the first units reaches abrasion detection positions due to opening and closing of the electric contacts.

DETAILED DESCRIPTION OF THE INVENTION

Figure 1:
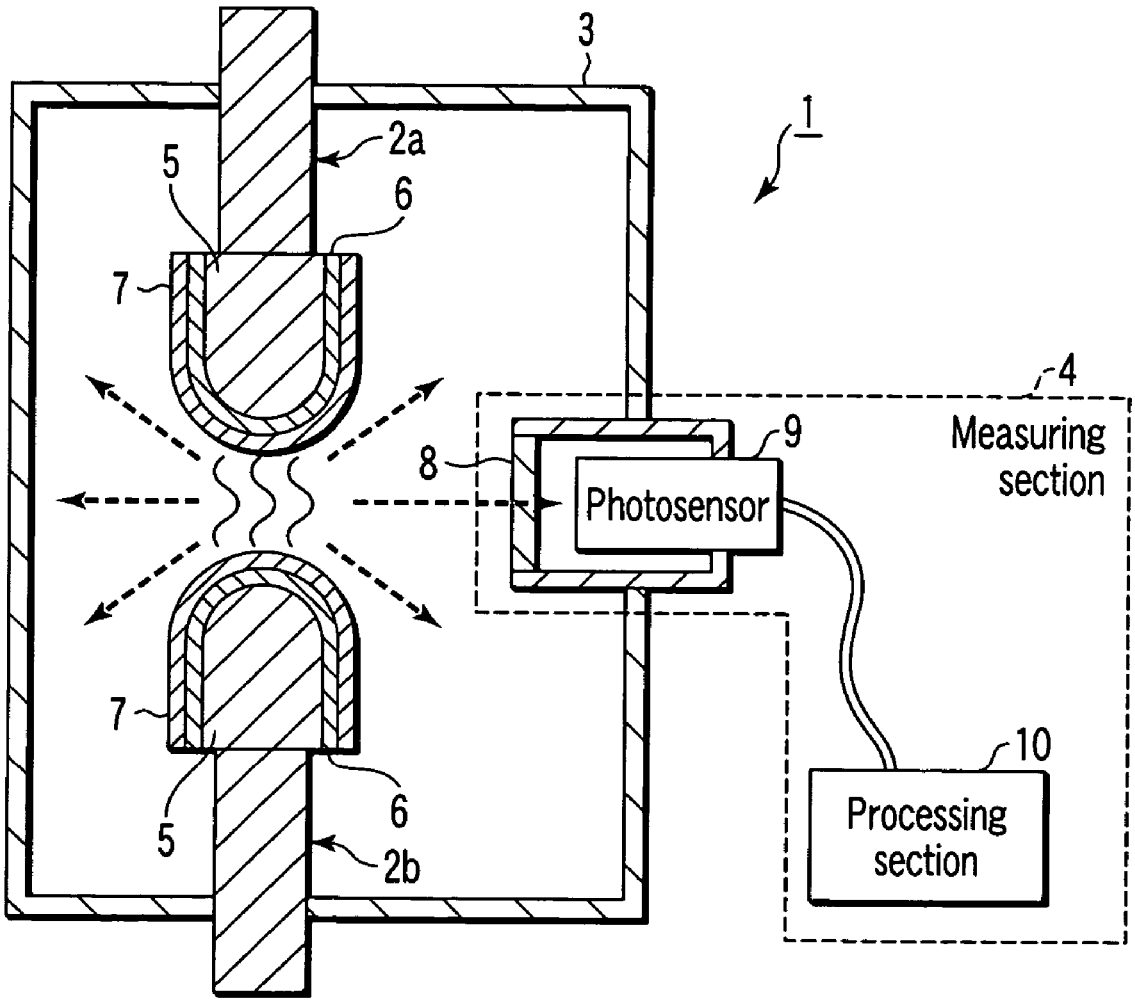
FIG. 1 is a vertical sectional view of an example of an electric contact apparatus according to the first embodiment.

The embodiments of the present invention will be explained with reference to the accompanying drawings. In the following explanations, the same elements will be denoted by the same reference numerals, respectively, and their explanations will be omitted after they are explained once.

THE FIRST EMBODIMENT

An electric contact apparatus according to the first embodiment detects abrasion of electric contacts by using electric contacts which enable the apparatus to detect that the abrasion of the electric contacts reaches a predetermined abrasion level prior to the limit of abrasion, when the abrasion of the electric contacts reaches positions (hereinafter referred to as "abrasion detection positions").

FIG. 1 is a vertical sectional view of the electric contact apparatus according to the first embodiment, which is denoted by reference numeral 1.

The electric contact apparatus 1 comprises a pair of electric contacts 2*a* and 2*b*, a housing 3, and a measuring section 4. In the electric contact apparatus 1, abrasion of the electric contacts 2*a* and 2*b* is detected.

The distal end portions of the electric contacts 2*a* and 2*b* are provided in the housing 3. The electric contacts 2*a* and 2*b* perform an electrical opening and closing operation for opening and closing an electric circuit.

The electric contacts 2*a* and 2*b* are separated from each other when the electric circuit is in its opened state, and contact each other when the electric circuit is in its closed state. The electric contacts 2*a* and 2*b* each include a base material portion 5, an indication layer (indication component layer) 6 and a surface processing layer 7. In the first embodiment, the electric contacts 2*a* and 2*b*, as stated above, contact each other when the electric circuit is in its closed state. However, the electric contacts 2*a* and 2*b* may be formed such that one of them is fitted in the other, when the electric circuit is in its closed state.

The base material portions 5 provided at the distal ends of the electric contacts 2*a* and 2*b* are located to face each other. The base material portions 5 each contain metal such as copper (Cu) and aluminum (Al), which is thus conductive. The surface processing layers 7 each also contain the same kind of metal as the base material portions 5 or metal such as silver (Ag), which is conductive. The surface processing layers 7 are provided on surface sides of the electric contacts 2*a* and 2*b*, respectively.

The indication layers 6 are provided on the outer peripheral surfaces of the base material portions 5. The surface layers 7 are provided on the outer peripheral surfaces of the indication layers 6. That is, the indication layers 6 are interposed between the base material portions 5 and the surface processing layers 7.

The indication layers 6 are located in abrasion detection positions of the electric contacts 2*a* and 2*b*. The abrasion detection positions are located close to positions where abrasion of the electric contacts 2*a* and 2*b* reaches the limit of abrasion. For example, the abrasion detection positions are located just before (closer to the surface sides of the electric contacts than) positions where the opening and closing operation of the electric contacts 2*a* and 2*b* become abnormal due to mechanical or electrical abrasion of the electric contacts 2*a* and 2*b*. In the first embodiment, the boundaries between the indication layers 6 and the surface processing layers 7 correspond to the abrasion detection positions.

When abrasion of the surface processing layers reaches the abrasion detection positions of at least one of the electric contacts 2*a* and 2*b*, at the time of opening and closing of the electric contacts 2*a* and 2*b*, the characteristics (e.g., at least one of the wavelength and light intensity) of light generated from the indication layers 6 differ from those of light generated from the surface processing layer 7.

The distal end portions of the electric contacts 2*a* and 2*b* are located in the housing 3. Also, the distal end portions of the base material portions 5 of the electric contacts 2*a* and 2*b* are located in the housing 3. The electric contacts 2*a* and 2*b* can be opened and closed by a driving device not shown which is located outside the housing 3.

A measuring section 4 detects light which is generated between the electric contacts 2*a* and 2*b* when the electric contacts 2*a* and 2*b* are opened and closed, and also detects abrasion of the electric contacts 2*a* and 2*b*. The measuring section 4 comprises a filter 8, a photosensor 9 and a processing section 10.

The filter 8 is provided on a light receiving side of the photosensor 9. The filter 8 selectively filters light generated as an arc between the electric contacts 2*a* and 2*b* at the time of opening and closing thereof, such that a light component of the light which has a given wavelength is transmitted through the filter 8.

For example, the filter 8 may be formed by selectively combining a number of kinds of filter elements having different wavelength selectivities, so that the light component of light which can be transmitted through the filter 8 varies in accordance with the combination of the filter elements.

The photosensor 9 measures light generated between the electric contacts 2*a* and 2*b* at the time of opening and closing of the electric contacts 2*a* and 2*b*, after the light is transmitted through the filter 8. To be more specific, of light generated between electric contacts 2*a* and 2*b*, a light component having a given wavelength, which is transmitted through the filter 8, is measured by the photosensor 9. The photosensor 9 converts the measured light component into an electrical signal, and outputs the electrical signal to the processing section 10.

The filter 8 and the light receiving side of the photosensor 9 are provided close to the electric contacts 2*a* and 2*b*. Also, the filter 8 and the light receiving side of the photosensor 9 are located in such a way as to project from the outside of the housing 3 thereinto. The photosensor 9 is connected to the processing section 10 located outside the housing 3. That is, the measuring section 4 measures light generated at the electric contacts 2*a* and 2*b* at the time of opening and closing thereof, after the light is transmitted through the filter 8, and outputs an electric signal from the photosensor 9 to the processing section located outside the housing 3.

The processing section 10 receives the electrical signal from the photosensor 9, and records and analyzes the electrical signal. The processing section 10 then carries out abrasion detection by determining whether abrasion of the electric contacts 2*a* and 2*b* has reached the abrasion detection positions.

Each of the electric contacts 2*a* and 2*b* will be explained in detail.

Figure 2:
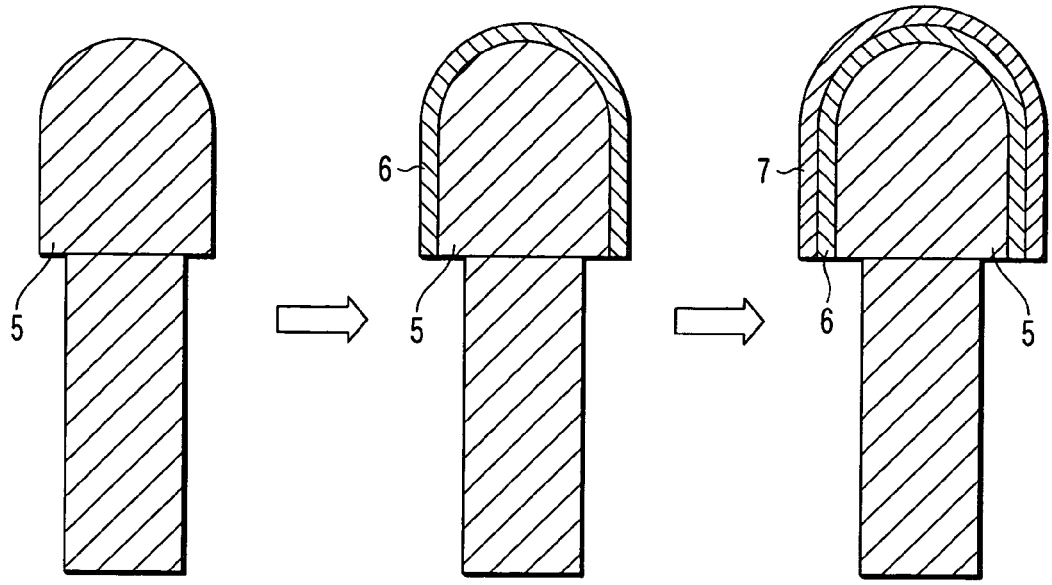
FIG. 2 is a vertical sectional view with respect to an example of manufacturing steps which are carried out on electric contacts.

FIG. 2 is a vertical sectional view with respect to an example of manufacturing steps which are carried out on each of the electric contacts 2*a* and 2*b*.

First, in each of the electric contacts 2*a* and 2*b*, the indication layer 6 is provided on the outer peripheral surface of the base material portion 5, and is different from the surface processing layer 7 regarding at least one of the wavelength and intensity of generated light.

The indication layer 6 is formed by applying, e.g., a plating method (such as electroplating, electroless plating or hot dipping) to the outer peripheral surface of the base material portion 5.

The indication layer 6 may be provided by using a method other than the plating method, such as thermal spraying, raised welding, pressure welding or HIP (Hot Isostatic Pressing) in which heat treatment is carried out while applying a pressure. Also, when each of the electric contacts 2*a* and 2*b* is molded, the indication layer 6 may be formed of a clad material in which a component is sandwiched between other components, e.g., copper plates or aluminum plates, which are the same as the component of the surface processing layer 7.

For example, the component of the indication layer 6 is metal or alloy, which is different from that of the surface processing layer 7 regarding at least one of the wavelength and intensity of generated light.

Then, the surface processing layer 7 is provided on the outer peripheral surface of the indication layer 6, and is different from the surface processing layer 6 in at least one of the wavelength and intensity of generated light. The component of the surface processing layer 7 may be formed of metal which is the same as that of the base material portion 5 regarding at least one of the wavelength and intensity of generated light or high conductive material such as Ag. The indication layer 6 is covered by the surface processing layer 7.

Thereby, the electric contacts 2*a* and 2*b* are formed such that the indication layers 6 are interposed between the base material portions 6 and the surface processing layers 7, i.e., the indication layers 6 are located in the abrasion detection positions.

In the case where the electric contacts 2*a* and 2*b* are formed of a component to which the plating method cannot be applied, or of alloy containing a component to which the plating method cannot be applied, their formation is carried out by thermal spraying, raised welding, pressure welding, HIP or cladding.

The indication layer 6 is formed of a component which is different in emission spectrum from a component widely used in electrodes, and a component which is different in a component, e.g., silver, aluminum or copper, which is the same as the component of the surface processing layer 7.

It is necessary that the component of the indication layer 6 does not overlap with that of the surface processing layer 7 in emission spectrum.

Figure 3:
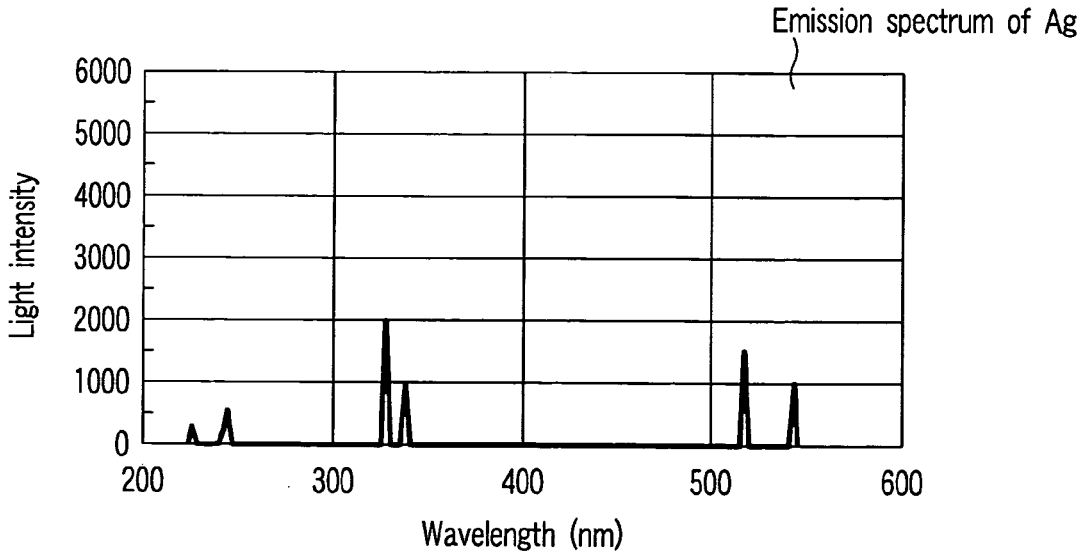
FIG. 3 is a graph showing an emission spectrum of Ag which is the first example of the component of a surface processing layer.

FIG. 3 is a graph showing an emission spectrum of Ag which is the first example of the component of the surface processing layer 7.

Figure 4:
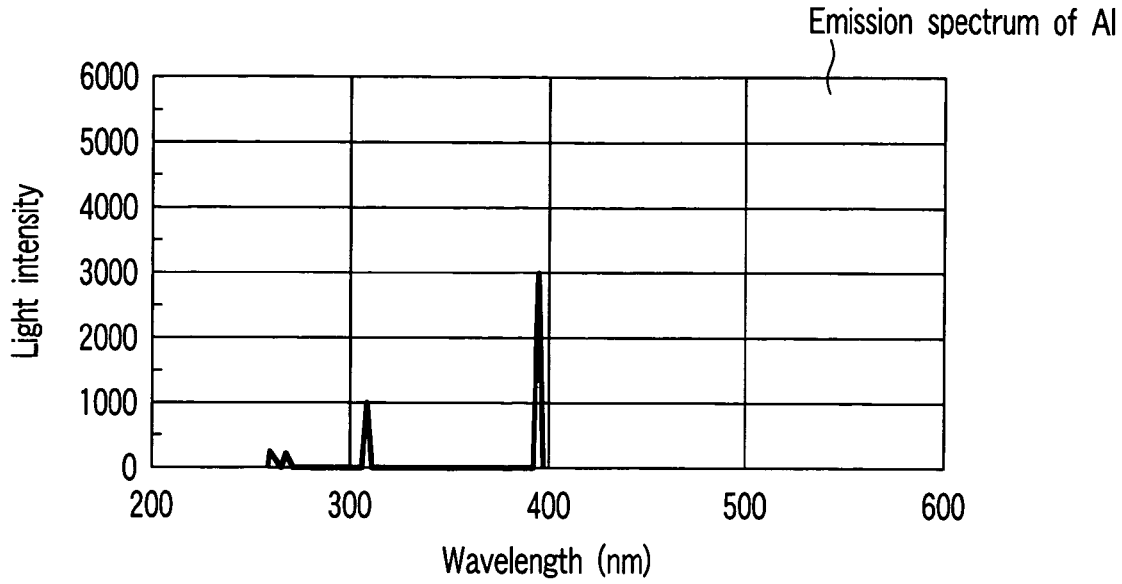
FIG. 4 is a graph showing an emission spectrum of Al which is the second example of the component of the surface processing layer.

FIG. 4 is a graph showing an emission spectrum of Al which is the second example of the component of the surface processing layer 7.

Figure 5:
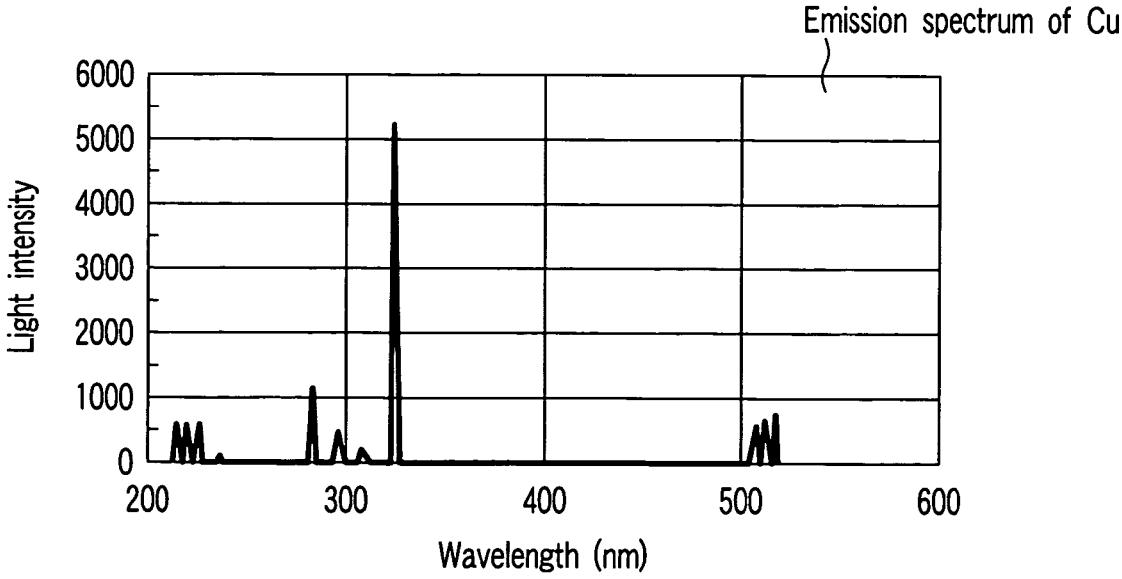
FIG. 5 is a graph showing an emission spectrum of Cu which is the third example of the component of the surface processing layer.

FIG. 5 is a graph showing an emission spectrum of Cu which is the third example of the component of the surface processing layer 7.

As shown in FIGS. 3 to 5, the representative examples of the component of the surface processing layer 7 have characteristics in which the intensities of light generated from them do not have a peak at approximately from 400 nm to 500 nm.

Therefore, a component from which light having a high intensity at approximately from 400 nm to 500 nm is generated is suitable as the component of the indication layer 6.

Figures 6, 7:
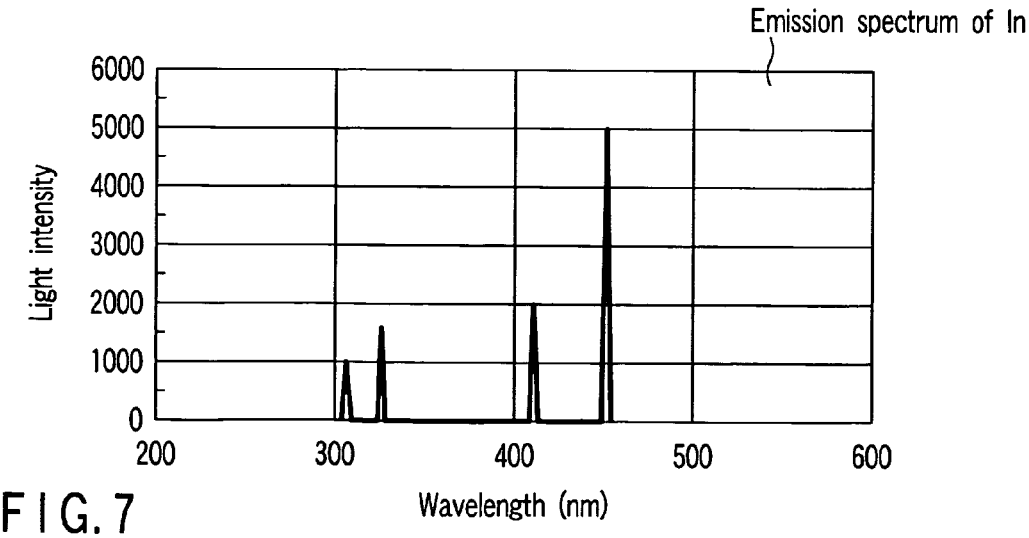
FIG. 6 shows a list of elements each suitable as the component of an indication layer, and having characteristics in which the intensities of light generated from the elements are high at approximately 400 nm to 500 nm.
FIG. 7 is a graph showing an emission spectrum of indium (In) which is an example of the component of the indication layer.

FIG. 6 shows a list of elements each suitable as the component of the indication layer 6, and having characteristics in which the intensities of light generated from the elements are high at approximately from 400 nm to 500 nm.

For example, Ba (approximately 455 nm), Bi (approximately 472 nm), Cs (approximately 459 nm), Eu (approximately 459 nm), Fe (approximately 440 nm), Ga (approximately 417 nm), Hg (approximately 435 nm), La (approximately 433 nm), Li (approximately 460 nm), Nb (approximately 405 nm), Pb (approximately 405 nm), Rb (approximately 420 nm), Re (approximately 488 nm) and Sr (approximately 460 nm) are each suitable as the component of the indication layer 6, since the intensities of light generated from those elements are high at approximately from 400 nm to 500 nm.

In order to increase the intensity of the electric contacts 2*a* and 2*b*, the electric contacts 2*a* and 2*b* may be formed of an appropriate one of various kinds of alloys.

FIG. 7 is a graph showing an emission spectrum of indium (In) which is an example of the component of the indication layer 6.

Light generated from indium has a high intensity at a wavelength of approximately 410 nm and that of approximately 451 nm. The indication layers 6 including indium are located in abrasion detection positions of the electric contacts 2*a* and 2*b*. The filter 8 cuts light of a wavelength of approximately less than 400 nm and that of approximately more than 500 nm which is generated at the electric contacts 2*a* and 2*b* at the time of opening and closing thereof. The photosensor 9 measures intensity of the light transmitted through the filter 8. The processing section 10 judges whether or not a measuring result is included in a given range. The electric contact apparatus 1 can detect that abrasion of the electric contacts 2*a* and 2*b*.

In the case where chromium (cr) is used as the component of the indication layer 6 instead of indium, light generated from chromium can be clearly observed at approximately 428 nm. Also, tin (Sn) and zinc (Zn) may be each used as the component of the indication layer 6.

In the first embodiment, when the electric contacts 2*a* and 2*b* start to operate, light emission by the surface processing layers 7 at the surfaces of the electric contacts 2*a* and 2*b* is measured as an arc generated between the electric contacts 2*a* and 2*b* at the time of opening and closing thereof.

Thereafter, when the opening and closing operation of the electric contacts 2*a* and 2*b* is repeated, the surface processing layers 7 at the surfaces of the electric contacts 2*a* and 2*b* are gradually thinned, and then the indication layers 6 are exposed at the electric contacts 2*a* and 2*b*.

Therefore, the emission characteristics of the electric contacts 2*a* and 2*b* at the time of opening and closing thereof vary, and it can be thus directly detected that abrasion of the surface processing layer 7 of the electric contacts 2*a* and 2*b* reaches the abrasion detection positions.

As a result, abrasion of the electric contacts 2*a* and 2*b* can be detected before the limit of abrasion, and monitoring and maintenance of electric contacts 2*a* and 2*b* can thus be easily carried out. The accurate operations of electric contacts 2*a* and 2*b* can be guaranteed, and the security and reliability and each of an electric device and an electric equipment can be improved.

Furthermore, in the first embodiment, light transmitted through the filter 8 is measured by the photosensor 9, as a result of which only light having a given wavelength can be measured, and the accuracy of abrasion detection can be improved.

In addition, in the first embodiment, the measurement precision of the photosensor 9 is improved, as compared with the conventional apparatus or method. This is because the filter 8 is a combination of various kinds of filter elements having different wavelength selectivities, and the wavelength of light to be transmitted through the filter 8 can be further finely limited by the filter 8.

THE SECOND EMBODIMENT

The second embodiment will be explained as a modification of the first embodiment.

In the second embodiment, surface processing layers are provided on distal end portions of base material portions, and abrasion is detected when light emission at the opening and closing time of the electric contacts is changed from light emission of the surface processing layers to that of the base material portions.

Figure 8:
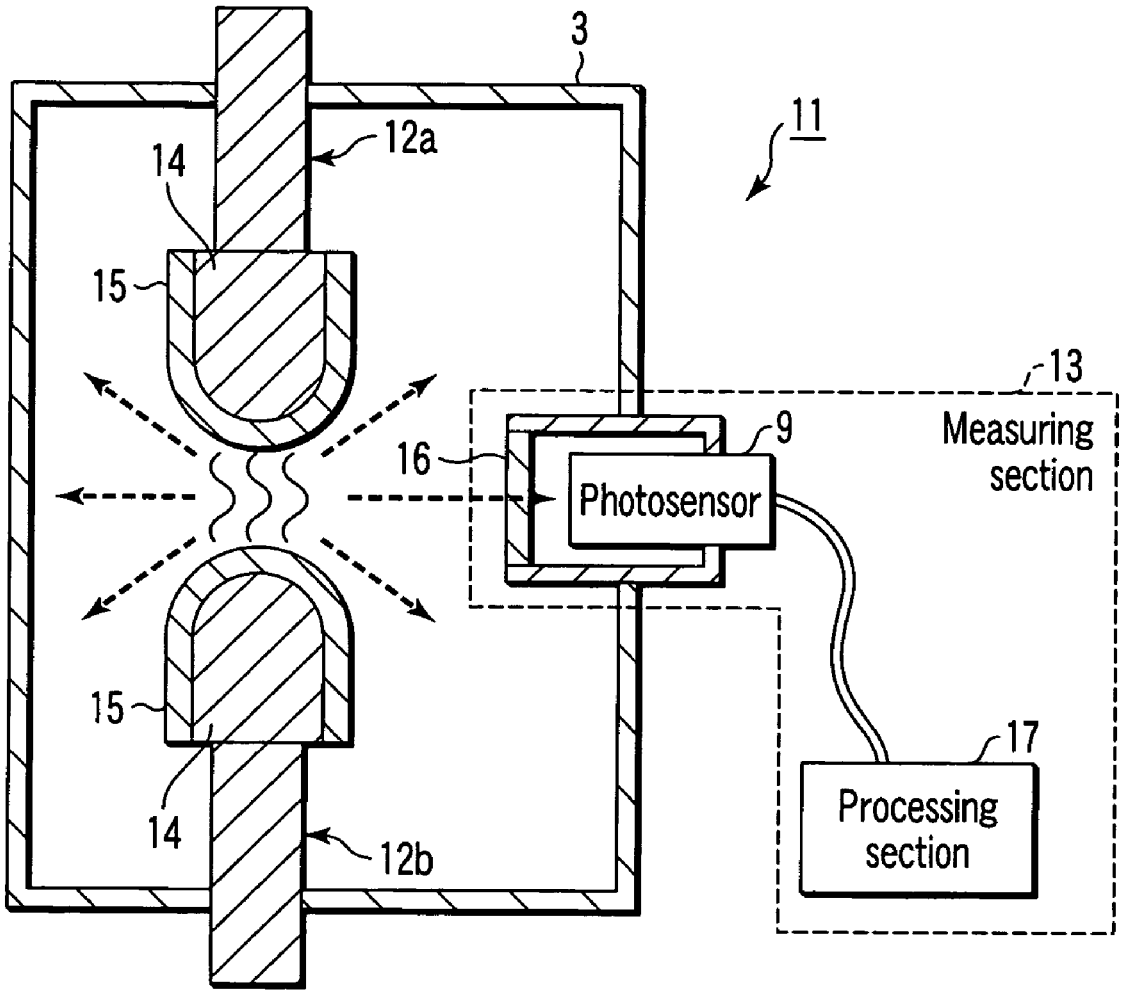
FIG. 8 is a vertical sectional view of an example of an electric contact apparatus according to the second embodiment of the present invention.

FIG. 8 is a vertical sectional view of an example of an electric contact apparatus according to second embodiment of the present invention, which is denoted by reference numeral 11.

More specifically, in the second embodiment, the electric contact apparatus 11 comprises the electric contacts 12*a* and 12*b*, the housing 3 and a measuring section 13.

The electric contacts 12*a* and 12*b* comprise base material portions 14 and surface processing layers 15.

In the second embodiment, the boundaries between the base material portions 14 and the surface processing layers 15 serve as abrasion detection positions.

The characteristics of light which is generated from the base material portions 14 at the time of opening and closing of the electric contacts 12*a* and 12*b* when abrasion of the surface processing layers 15 reach the abrasion detection positions are different from those of light generated from the surface processing layers 15 at the time of opening and closing of the electric contacts 12*a* and 12*b*. The distal end portions of the electric contacts 12*a* and 12*b* are located in the housing 3. The electric contacts 12*a* and 12*b* can be opened and closed by a driving device not shown which is located outside. The surface processing layers 15 contain conductive material, and can be operated as electrodes.

The measuring section 13 comprises a filter 16, a photosensor 9 and a processing section 17.

Of light generated from the base material portions 14 at the time of opening and closing of the electric contacts 12*a* and 12*b*, the filters 16 allow light having a given wavelength to be transmitted through the filters 16. To be more specific, of light generated between the electric contacts 12*a* and 12*b*, light having a given wavelength which is transmitted through the filter 16 is measured by the photosensor 9. The photosensor 9 converts the measured light into an electrical signal, and outputs the electrical signal to the processing section 17.

The processing section 17 detects abrasion of the electric contacts 12*a* and 12*b* based on variation of the characteristics of the light.

Detection of abrasion of the electric contacts 12*a* and 12*b* will be explained by referring to the case where the surface processing layers 15 contain silver, and the base material portions 14 contain aluminum.

When the electric contacts 12*a* and 12*b* start to operate, light emission by the surface processing layers 15 at the surfaces of the electric contacts 12*a* and 12*b* is measured as an arc generated between the electric contacts 12*a* and 12*b* at the time of opening and closing thereof.

In the case where the surface processing layers 15 contain silver, it is detected that light generated from the surface processing layers 15 has a high intensity at approximately 330 nm, 520 nm and 550 nm as shown in FIG. 3.

Thereafter, when the opening and closing operation of the electric contacts 12*a* and 12*b* is repeated, the surface processing layers 15 at the surfaces of the electric contacts 12*a* and 12*b* are gradually thinned, and then the base material portions 14 are exposed at the surfaces of the electric contacts 12*a* and 12*b*.

In the case where the base material portions 14 contain aluminum, it is detected that light generated from the base material portions 14 has a high intensity at approximately 395 nm as shown in FIG. 4.

Furthermore, in the case where the base material portions 14 contain copper, it is detected that light generated from the base material portions 14 has a high intensity at approximately 330 nm as shown in FIG. 5.

The processing section 17 detects light generated from the material of the base material portions 14, to thereby detect the difference between the spectrums of light which are obtained before and after abrasion of the surface processing layers 15.

In the case where the surface processing layers 15 are formed on the outer peripheral surfaces of the base material portions 14 by a plating method, even if any of, e.g., electroplating, electroless plating and hot dipping is applied as the plating method, the surface processing layers 15 can be formed to have a given thickness which falls within an allowable range set for abrasion, and is substantially equal to those obtained when the other plating methods are applied.

In the second embodiment, when the surface processing layers 15 are abraded, the emission characteristics thereof at the time of opening and closing of the electric contacts 12*a* and 12*b* vary, as a result of which it can be directly detected that abrasion of the surface processing layers 15 reaches the abrasion detection positions.

THE THIRD EMBODIMENT

The third embodiment will be explained as another modification of the first embodiment. In electric contacts in the third embodiment, holes are formed in the distal end portions of base material portions, indication portions are provided in abrasion detection positions in the holes, and the holes are covered with caps.

Figure 9:
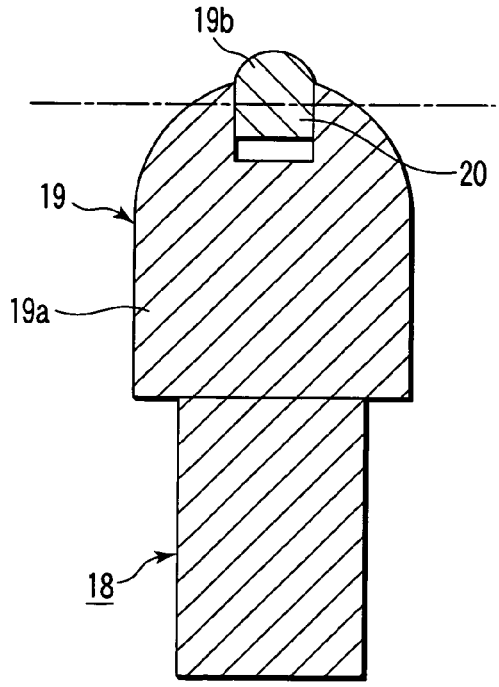
FIG. 9 is a vertical sectional view of an example of electric contacts in the third embodiment of the present invention.

FIG. 9 is a vertical sectional view of an example of electric contacts in the third embodiment.

In the third embodiment, electric contacts 18 comprise base material portions 19 and indication portions 20.

The base material portions 19 comprise base material bodies 19*a* and caps 19*b*.

Holes are formed in the base material bodies 19*a* of the base material portions 19 at the distal ends of the electric contacts 18. In the holes, the indication portions 20 are provided. The caps 19*b* close opening portions of the holes. As a result, the indication portions 20 are held in the base material portions 19. The boundaries between the caps 19*b* and the indication portions 20 serve as the abrasion detection positions. The indication portions 20 are mechanically fixed to, e.g., the abrasion detection positions, and also fixed by the caps 19*b* from above.

To be more specific, in the base material bodies 19*a*, screw holes are formed, and then metal pieces containing components which can effect indication are screwed as the indication portions 20 in the abrasion detection positions. Furthermore, the caps 19*b* whose components are the same as those of the base material bodies 19*a* are also screwed, and then fixed by welding or the like. Then, the shapes of the base material portions 19 are corrected by machining or the like. Thereby, the indication portions 20 are embedded in the abrasion detection positions of the base material portions 19.

For example, the base material portions 19 each contain a component such as silver, aluminum or copper. The indication portions 20, at the time of opening and closing of the electric contacts 18, generate light the wavelength of which is different from that of light generated from the base material portions 19, when they are located at the surfaces of the electric contacts 18.

By virtue of the above structural feature, the characteristics of light generated by the opening and closing operations vary when abrasion of the electric contacts 18 progresses due to the opening and closing operation thereof, and reaches the abrasion detection positions.

THE FOURTH EMBODIMENT

The fourth embodiment will be explained as a further modification of the first embodiment.

In the fourth embodiment, each of electric contacts includes a number of indication layers in a number of abrasion detection positions indicating abrasion different levels.

Figure 10:
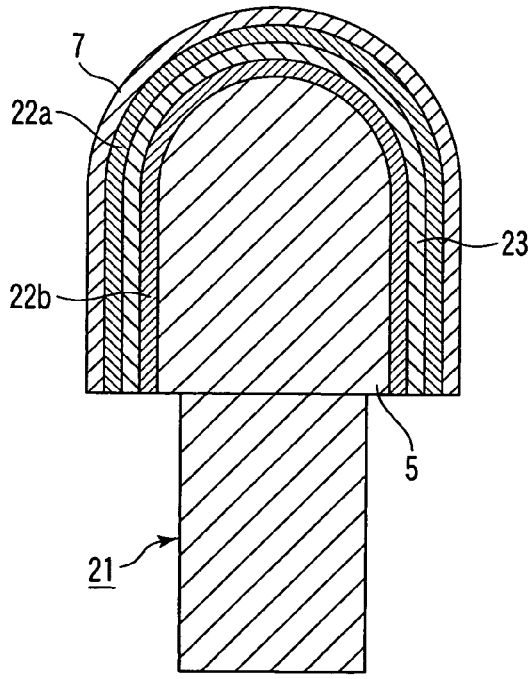
FIG. 10 is a vertical sectional view showing an example of electric contacts in the fourth embodiment of the present invention.

FIG. 10 is a vertical sectional view of an example of electric contacts in the fourth embodiment of the present invention.

More specifically, in the fourth embodiment, electric contacts 21 have multi-layer structures, and comprise base material portions 5, first indication layers 22*a*, second indication layers 22*b*, intermediate layers 23 and surface processing layers 7.

The second indication layers 22*b* are provided on the outer peripheral surfaces of the base material portions 19 provided at the distal ends of the electric contacts. The intermediate layers 23 are provided on the outer peripheral surfaces of the second indication layers 22*b*. The first indication layers 22*a* are provided on the outer peripheral surfaces of the intermediate layers 23. The surface processing layers 7 are provided on the outer peripheral surfaces of the first indication layers 22*a*.

In the fourth embodiment, the boundaries between the surface processing layers 7 and the first indication layers 22*a* serve as first abrasion detection positions. The boundaries between the intermediate layers 23 and the second indication layers 22*b* serve as second abrasion detection positions.

The base material layers 5, the intermediate layers 23 and the surface processing layers 7 contain any of silver, aluminum and copper, etc.

When the first indication layers 22*a* and the second indication layers 22*b* are exposed at the surfaces of the electric contacts 21 at the time of opening and closing thereof, each of the first indication layers 22*a* and the second indication layers 22*b* generates light having a wavelength differing from that of light generated from layers adjacent to each of the first indication layers 22*a* and the second indication layers 22*b*. In this case, the above layers adjacent to the first indication layers 22*a* are the surface processing layers 7 and the intermediate layers 23. The layers adjacent to the second indication layers 22*b* are intermediate layers 23. To be more specific, suppose the first indication layers 22*a* contain chromium, and the second indication layers 22*b* contain indium.

When the surface processing layers 7 abrade due to the opening and closing operation of the electric contacts 21; light having a wavelength of approximately 428 nm which is generated from chromium of the first indication layers 22*a* is measured.

Furthermore, when the opening and closing operation continues, the above light having a wavelength of approximately 428 nm which is generated from chromium reduces, and light having a wavelength of approximately 410 and a wavelength of approximately 450 nm which is generated from indium of the second indication layers 22*b* is measured.

It should be noted that appropriate combinations of suitable components can be used as the components of the first indication layers 22*a* and the second indication layers 22*b* by using thermal spraying, raised welding, pressure welding or cladding.

As explained above, in the fourth embodiment, the electric contacts 21 have multi-layer structures. When the opening and closing operation of the electric contacts 21 is repeated, conductive materials of which the surface processing layers are formed abrade, and then the surfaces of the first indication layers 22 appear. Consequently, at the time of the opening and closing operation, light which is generated from the first indication layers 22*a*, and is characteristic thereof is generated.

Then, when the opening and closing operations continue, the surfaces of the second indication layers 22*b* appear. As a result, light characteristic of the second indication layer 22*b* is generated.

Accordingly, the abraded states of the electric contacts 21 can be detected in stages.

THE FIFTH EMBODIMENT

An electric contact apparatus according to the fifth embodiment includes a housing 3 provided with a window.

In the following explanation, a structure wherein a window is added to the first embodiment will be referred to as the fifth embodiment. However, according to the fifth embodiment, the window can be also applied to the second to fourth embodiments.

Figure 11:
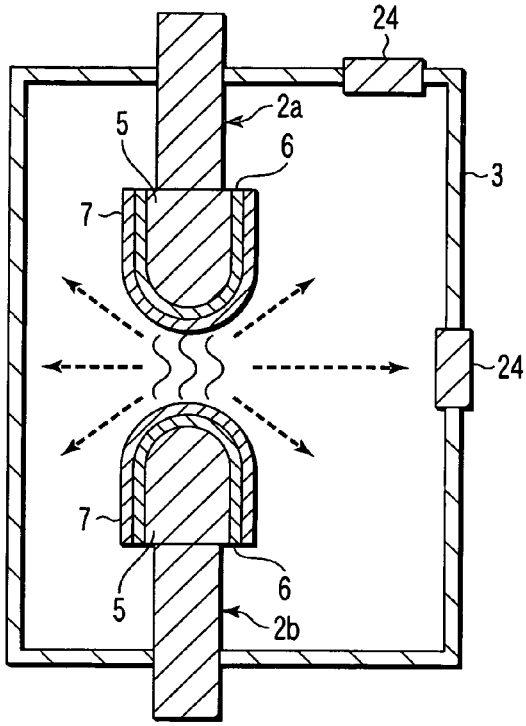
FIG. 11 is a vertical sectional view of an example of a structure wherein a window is provided in a housing, according to the fifth embodiment of the present invention.

FIG. 11 is a vertical sectional view of an example of a structure wherein the window is provided in the housing, according to the fifth embodiment.

In the fifth embodiment, windows 24 are fixed to the housing 3 by, e.g., flange. Light generated between the electric contacts 2*a* and 2*b* at the time of opening and closing thereof can be measured from the outside of the housing 3, after passing through the windows 24 located in arbitrary positions of the housing 3. For example, the windows 24 may be provided in positions where light generated between the electric contacts 2*a* and 2*b* at the time of opening and closing thereof is directly transmitted through the windows 24 or where the light is indirectly transmitted through the windows 24, i.e., it is transmitted therethrough after being reflected.

Figure 12:
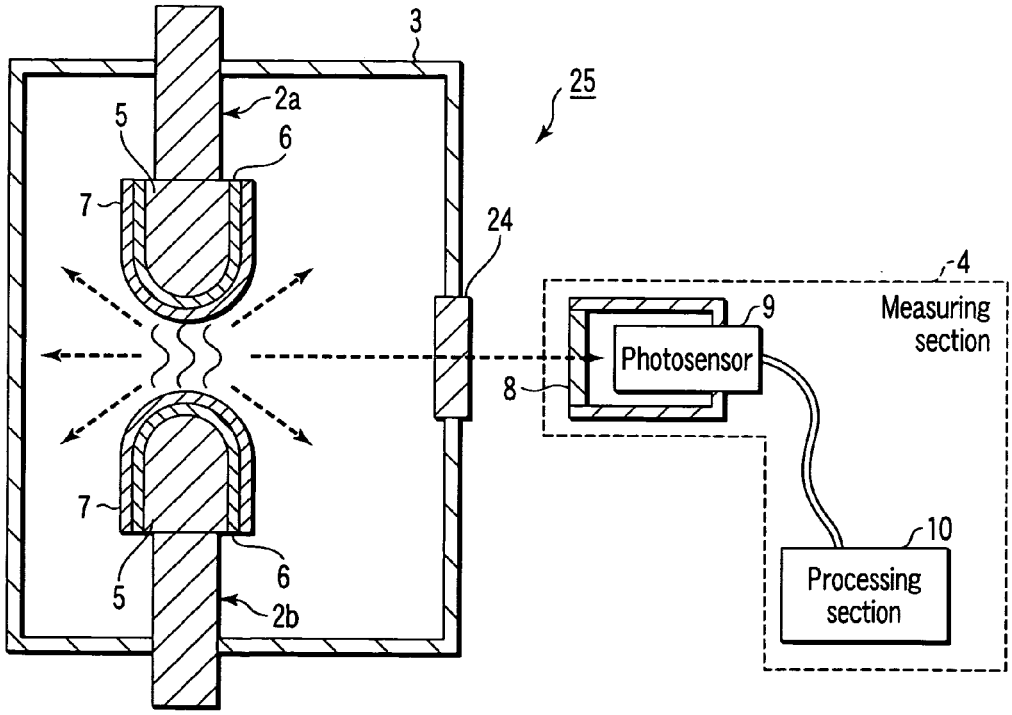
FIG. 12 is a vertical sectional view of the first example of an electric contact apparatus according to the fifth embodiment of the present invention.

FIG. 12 is a vertical sectional view of the first example of the electric contact apparatus according to the fifth embodiment, which is denoted by reference numeral 25.

In the electric contact apparatus 25, light generated between the electric contacts 2*a* and 2*b* at the time of opening and closing thereof is measured by the photosensor 9 through the window 24 and the filter 8. The measuring section 4 is provided outside the housing 3.

Figure 13:
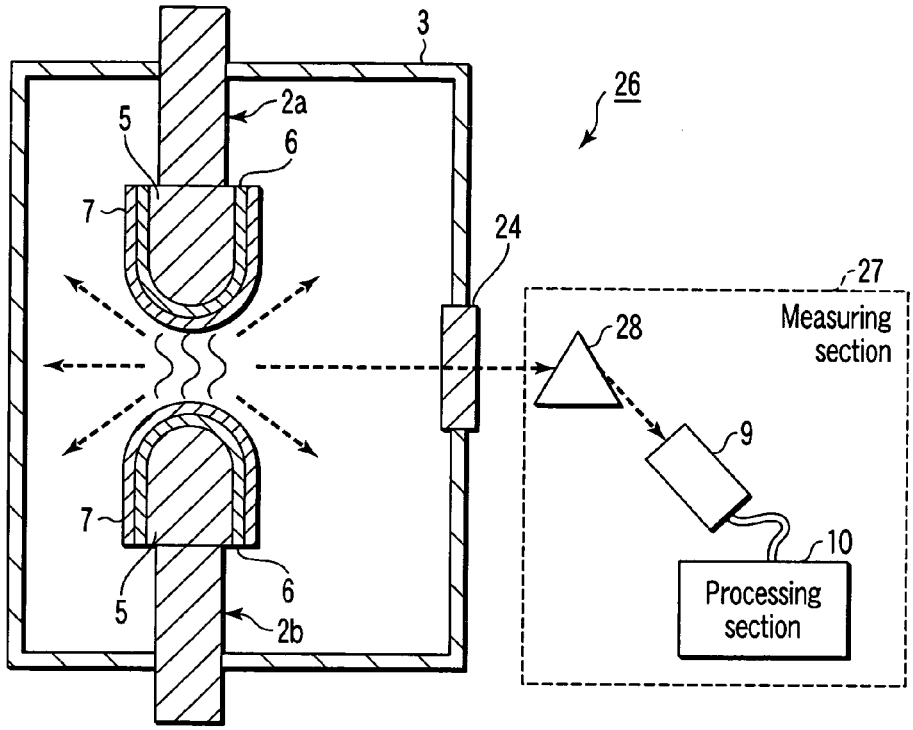
FIG. 13 is a vertical sectional view of the second example of the electric contact apparatus according to the fifth embodiment.

FIG. 13 is a vertical sectional view of the second example of the electric contact apparatus according to the fifth embodiment, which is denoted by reference numeral 26.

A measuring section 27 of the electric contact apparatus 26 comprises a wavelength dispersing section 28 such as a prism, the photosensor 9, and the processing section 10.

The wavelength dispersing section 28 receives light generated between the electric contacts 2*a* and 2*b* at the time of opening and closing thereof through the window 24, and disperses the light in wavelength, and outputs only a light component of the light which has a given wavelength or an emission spectrum of a given wavelength range to the photosensor 9.

The light generated between the electric contacts 2*a* and 2*b* at the time of opening and closing thereof is measured by the photosensor 9 through the window 24 and the wavelength dispersing section 28. The measuring section 27 is provided outside the housing 3.

In the fifth embodiment, abrasion of the electric contacts 2*a* and 2*b* is easily detected by using not only a dedicated light measuring device such as the measuring section 4, but a device such as the measuring section 27, which has a measuring function differing from that of the measuring section 4, as occasion arises.

THE SIXTH EMBODIMENT

The sixth embodiment will be explained as a modification of the fifth embodiment.

The electric contact apparatus according to the sixth embodiment, which is denoted by reference numeral 29, comprises a light-direction adjusting section 30 which is provided in the window 24, and which includes light transmission holes for adjusting the direction of light generated at the time of opening and closing of the electric contacts 2*a* and 2*b*.

Figure 14:
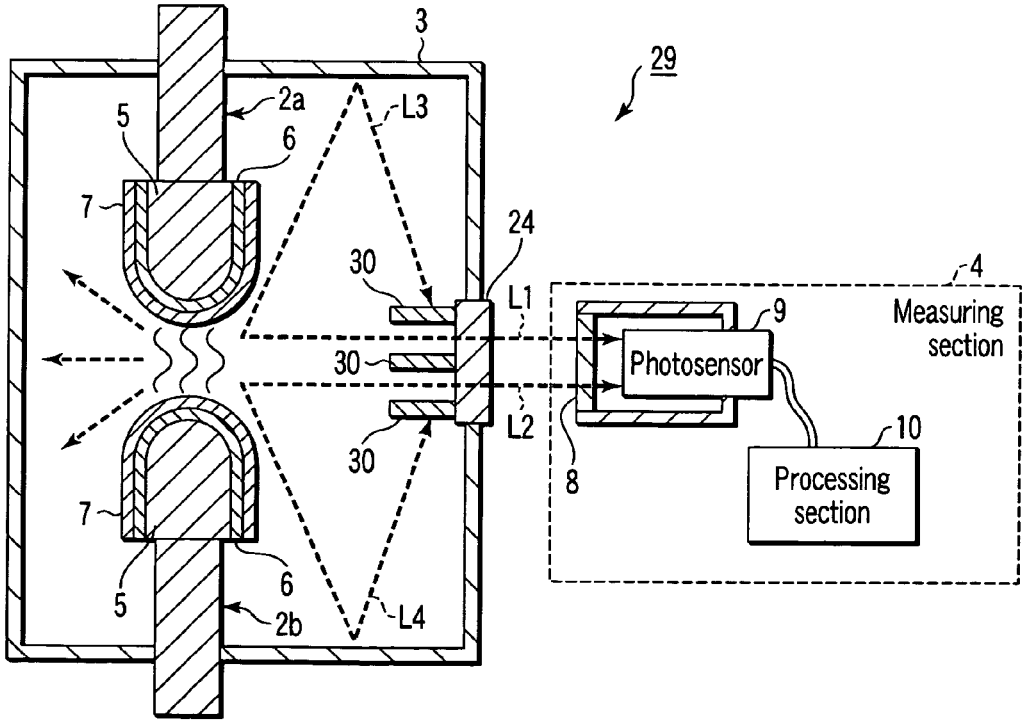
FIG. 14 is a vertical sectional view of an example of an electric contact apparatus according to the sixth embodiment of the present invention.

FIG. 14 is a vertical sectional view of an example of the electric contact apparatus 29 according to the sixth embodiment of the present invention.

To be more specific, in the electric contact apparatus 29, the window 24 allows the light generated between the electric contacts 2*a* and 2*b* at the time of opening and closing thereof to be transmitted through the window 24, and is provided at a side surface of the housing 3 which is parallel to a direction in which the electric contacts 2*a* and 2*b* are opened/closed.

The light-direction adjusting section 30 is provided at the window 24. The light-direction adjusting section 30 is a stray-light removing mechanism which is formed in the shape of an optical grating or slits in such a way as to project into the housing 3. The light-direction adjusting section 30 allows only directly incident light components L1 and L2 of the light generated between the electric contacts 2*a* and 2*b* at the time of opening and closing thereof to be transmitted through the light-direction adjusting section 30, but does not allow stray light components L3 and L4 of the light to be transmitted through the light-direction adjusting section 30. In addition, the light-direction adjusting section 30 is painted black so as to allow only the light components L1 and L2 to be transmitted through the light-direction adjusting section 30, and so as to absorb the other light components. Referring to FIG. 14, in the light-direction adjusting section 30, plural plates are provided in parallel with the light components L1 and L2.

In the sixth embodiment, light reflected by an inner wall or a part or parts in the housing 3 cannot be transmitted through the window 24, since it is blocked by the light-direction adjusting section 30. Thus, a noise generated due to the reflected light can be reduced, and also fluorescence or phosphorescence generated from a part or parts in the housing 3 can be reduced, thereby improving the measurement precision.

Figure 15:
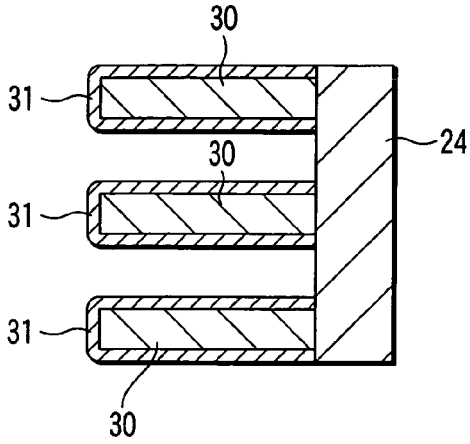
FIG. 15 is a vertical sectional view of a light-direction adjusting section to which adsorption material is added.

In the sixth embodiment, appropriate absorption material 31 for absorbing a decomposition product generated due to discharge may be provided as shown in FIG. 15. Thereby, a cracked gas or a decomposition product, which causes lowering of the measurement precision, is prevented from adhering to the window 24, and the window 24 is preventing from being soiled, thus restricting lowering of the measurement sensitivity to light.

THE SEVENTH EMBODIMENT

The seventh embodiment will be explained as a modification of a combination of the first and second embodiments.

In the electric contact apparatus according to the seventh embodiment, which is denoted by reference numeral 32, light generated between the electric contacts is output to the outside of the housing through an optical fiber, and is measured.

The following explanation of the seventh embodiment is given with respect to the case where an optical fiber is applied to the first embodiment. However, in the seventh embodiment, the optical fiber can be applied to any of the other embodiments.

Figure 16:
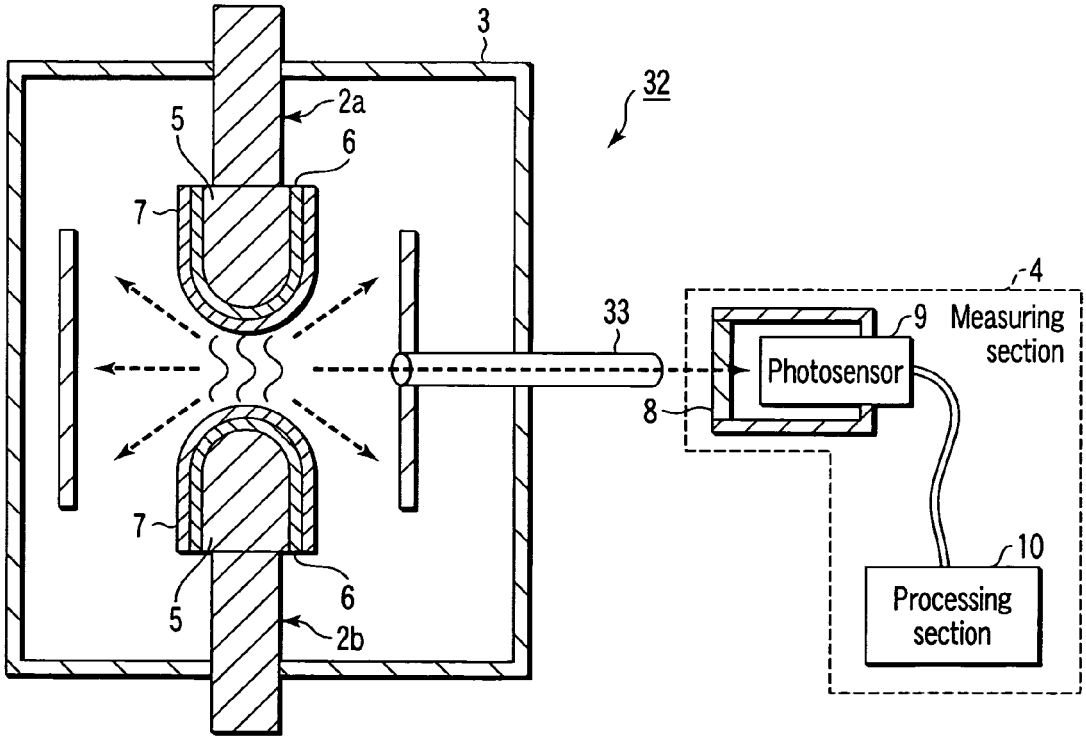
FIG. 16 is a vertical sectional view of an example of an electric contact apparatus according to the seventh embodiment of the present invention.

FIG. 16 is a vertical sectional view of an example of the electric contact apparatus 32 according to the seventh embodiment.

In the electric contact apparatus 32, one (light receiving portion) of the ends of an optical fiber 33 is located close to the electric contacts 2*a* and 2*b* within the housing 3, and the other is located outside the housing 3.

The optical fiber 33, from the above one end thereof, receives light generated between the electric contacts 2*a* and 2*b* at the time of opening and closing thereof, and guides the light to the other end. The measuring section 4 located outside the housing 3 measures the light output from the other end of the optical fiber 33, to thereby perform abrasion detection.

That is, the optical fiber 33 is provided to extend from the inside of the housing 3 to the outside thereof, and the other end of the optical fiber 33 is connected to the measuring section 4.

In the seventh embodiment, light generated between the electric contacts 2*a* and 2*b* at the time of opening and closing thereof can be measured in an arbitrary position in the outside of the housing 3 through the optical fiber 3, and abrasion of the electric contacts 2*a* and 2*b* can be detected in the arbitrary position.

Furthermore, although whether or not the following formation of the optical fiber 33 can be achieved depends on the wavelength of light generated from the indication layer 6, there is a case where the optical fiber 33 can be formed to have characteristics which prevents transmission of ultraviolet rays. In this case, a filter for blocking a light component of shortwave can be omitted.

If a plurality of pairs of electric contacts 2*a* and 2*b* are provided and monitored, a plurality of optical fibers 33 are provided such that one end of each of the optical fibers 33 is located close to an associated pair of electric contacts 2*a* and 2*b* of the plurality of pairs of electric contacts 2*a* and 2*b*. That is, the optical fibers 33 are provided to extend from the inside of the housing 3 to the outside thereof for the pairs of electric contacts 2*a* and 2*b*, respectively. The other end of each optical fiber 33 is connected to an associated one of a plurality of measuring sections 4.

By virtue of the above structural feature, abrasion detection can be performed in units of one pair of electric contacts 2*a* and 2*b*.

Moreover, the measuring sections 4 do not need to be located close to the housing 3, and can be concentratively provided in a certain place, thus reducing the restrictions on the entire structure of the electric contact apparatus and the arrangement of the structural elements thereof.

When there is a slight possibility that abrasion of the electric contacts 2*a* and 2*b* may be detected, e.g., just after use of the electric contact apparatus 32 is started, if it is not necessary to monitor abrasion in units of one pair of electric contacts 2*a* and 2*b*, the optical fibers 33 respectively located close to the pairs of electric contacts 2*a* and 2*b* may be bundled and connected to one measuring section 4.

As described above, since the other ends of the optical fibers 33 are located outside the housing 3, and are connected to one measuring section 4, the pairs of the electric contacts 2*a* and 2*b* can be concentratively monitored by one measuring section 4.

It should be noted that the above embodiments can be freely selectively combined, and any of the pairs of electric contacts 2*a* and 2*b*, 12*a* and 12*b*, 18, and 21 can be applied to each of the electric contact apparatuses 1, 11, 25, 26, 29 and 32.

In each of the above embodiments, each of the indication layer 6, the first indication layer 22*a*, the second indication 22*b* and the indication portion 20 can be formed of any of metal, alloy and a luminiferous material.

In each embodiment, the indication layers 6, 6 of the two electric contacts 2*a* and 2*b*, may be made of different two metals, respectively. That is, the composition of the indication layer 6 of the electric contact 2*a*, along with the description of each embodiment, may be different from that of the electric contact 2*b*. In this case, it can be detected which one of the electric contacts reaches the abrasion detection position if the abrasion is asymmetrical.

In each embodiment, as long as each of the structural elements can maintain its function, each element may be freely modified, its place may be changed to another place, the elements may be freely selectively combined, and each of them may be divided into parts.

What is claimed is:

1. A pair of electric contacts comprising:

a pair of first units provided on surfaces of end sides of the electric contacts, respectively, and emitting light having first characteristics at an opening and closing operation time at which the electric contacts are opened and closed;

a pair of second units covered with the first units, respectively, and emitting light having second characteristics which differ from the first characteristics, when abrasion of the first units reaches abrasion detection positions at the opening and closing operation time, the abrasion of the first units being caused by an opening and closing operation of the electric contacts; and a pair of base material portions, respectively, wherein the second units are indication layers provided on outer peripheral surfaces of the base material portions, and the first units are surface processing layers provided on outer peripheral surfaces of the indication layers.

2. The electric contacts according to claim 1, wherein each of the indication layers is any of metal, alloy and a luminiferous material.

3. The electric contacts according to claim 1, wherein the surface processing layers are formed on the outer peripheral surfaces of the base material portions by a plating method.

4. The electric contacts according to claim 1, wherein the first characteristics and the second characteristics are different from each other in at least one of wavelength and intensity of the light.

5. An electric contact apparatus including the electric contacts according to claim 1, further comprising:

a photosensor which measures light generated at the opening and closing time; and a processing section which detects abrasion of the electric contacts based on the characteristics of the light measured by the photosensor.

6. The electric contact apparatus according to claim 5, further comprising:

a housing which contains distal end portions of the electric contacts; and a filter which selects a light component having a given wavelength, and allow the light component to be transmitted through the filter, wherein the photosensor measures light generated at the opening and closing time through the filter.

7. The electric contact apparatus according to claim 6, wherein the filter has a structure obtained by combining a plurality of kinds of filter elements having different wavelength selectivities, and the light component having the given wavelength which is allowed to be transmitted through the filter is variable.

8. The electric contact apparatus according to claim 1, further comprising:

an optical fiber which receives, from one end thereof, light generated at the opening and closing operation time, and guide the light to the other end of the optical fiber; and a processing section which detects abrasion of the electric contacts based on the characteristics of the light output from the other end of the optical fiber.

9. The electric contact apparatus according to claim 8, further comprising a housing containing distal end portions of the electric contacts, and wherein the optical fiber guides the light generated at the opening and closing operation time from the inside of the housing to the outside of the housing.

10. The electric contact apparatus provided with a plurality of pairs of electric contacts including the pair of electric contacts according to claim 1, further comprising:

a plurality of optical fibers provided at the plurality of pairs of electric contacts, respectively, each of the optical fibers which receive, from one end of each optical fiber, light generated at the opening and closing time, and guide the light to the other end of each optical fiber; and a plurality of processing sections provided for the plurality of optical fibers, respectively, each of the processing sections being configured to detect abrasion of an associated pair of electric contacts of the plurality of pairs of electric contacts based on the characteristics of the light output from the other end of an associated one of the plurality of optical fibers.

11. The electric contact apparatus provided with a plurality of pairs of electric contacts including the pair of electric contacts according to claim 1, further comprising:

a plurality of optical fibers provided at the plurality of pairs of electric contacts, respectively, each of the optical fibers which receive, from one end of each optical fiber, light generated at the opening and closing time, and guide the light to the other end of each optical fiber; and a processing section which detects abrasion of the plurality of pairs of electric contacts based on the characteristics of the light output from the other end of an associated one of the plurality of optical fibers.

12. A method for detecting abrasion of the electric contacts according to claim 1, comprising:

measuring light generated at the opening and closing time by using a photosensor; and detecting abrasion of the electric contacts by using a processing section based on the characteristics of the light measured by the photosensor.

13. A pair of electric contacts comprising:

a pair of first units provided on surfaces of end sides of the electric contacts, respectively, and emitting light having first characteristics at an opening and closing operation time at which the electric contacts are opened and closed; and a pair of second units covered with the first units, respectively, and emitting light having second characteristics which differ from the first characteristics, when abrasion of the first units reaches abrasion detection positions at the opening and closing operation time, the abrasion of the first units being caused by an opening and closing operation of the electric contacts, wherein the first units include ends in which holes are formed, and contain the second units in the holes in the ends, and caps are fitted in the holes.

14. A pair of electric contacts comprising:

a pair of first units provided on surfaces of end sides of the electric contacts, respectively, and emitting light having first characteristics at an opening and closing operation time at which the electric contacts are opened and closed;

a pair of second units covered with the first units, respectively, and emitting light having second characteristics which differ from the first characteristics, when abrasion of the first units reaches abrasion detection positions at the opening and closing operation time, the abrasion of the first units being caused by an opening and closing operation of the electric contacts; and a plurality of second units including an associated one of the second units, wherein the plurality of second units are provided for a plurality of abrasion detection positions which indicate respective abrasion levels.

15. A pair of electric contacts comprising:

a pair of first units provided on surfaces of end sides of the electric contacts, respectively, and emitting light having first characteristics at an opening and closing operation time at which the electric contacts are opened and closed;

a pair of second units covered with the first units, respectively, and emitting light having second characteristics which differ from the first characteristics, when abrasion of the first units reaches abrasion detection positions at the opening and closing operation time, the abrasion of the first units being caused by an opening and closing operation of the electric contacts; and a pair of base materials portions which perform the opening and closing operation, wherein the second units are indication portions provided on the base material portions, and contain at least one selected from the group consisting of Eu, La, Li, Ga, Pb, Nb, Rb, Cr, Hg, Fe, In, Ba, Cs, Sr, Bi and Re, and the first units are surface processing layers provided on outer peripheral surfaces of the indication layers.

16. An electric contact apparatus comprising:

a pair of electric contacts;

a photosensor which measures light generated at the opening and closing time;

a processing section which detects abrasion of the electric contacts based on the characteristics of the light measured by the photosensor;

a housing which contains distal end portions of the electric contacts; and a window provided at the housing, wherein the photosensor measures light generated at the opening and closing time through the window, and the electric contacts comprise, a pair of first units provided on surfaces of end sides of the electric contacts, respectively, and emitting light having first characteristics at an opening and closing operation time at which the electric contacts are opened and closed; and a pair of second units covered with the first units, respectively, and emitting light having second characteristics which differ from the first characteristics, when abrasion of the first units reaches abrasion detection positions at the opening and closing operation time, wherein the abrasion of the first units is caused by an opening and closing operation of the electric contacts.

17. An electric contact apparatus comprising:

a pair of electric contacts;

a photosensor which measures light generated at the opening and closing time;

a processing section which detects abrasion of the electric contacts based on the characteristics of the light measured by the photosensor;

a housing which contains distal end portions of the electric contacts; and a light-direction adjusting section including light transmission holes which adjusts a traveling direction of light generated at the opening and closing time, wherein the photosensor measures the light generated at the opening and closing time through the light-direction adjusting section, and the electric contacts comprise, a pair of first units provided on surfaces of end sides of the electric contacts, respectively, and emitting light having first characteristics at an opening and closing operation time at which the electric contacts are opened and closed; and a pair of second units covered with the first units, respectively, and emitting light having second characteristics which differ from the first characteristics, when abrasion of the first units reaches abrasion detection positions at the opening and closing operation time, wherein the abrasion of the first units is caused by an opening and closing operation of the electric contacts.

18. The electric contact apparatus according to claim 17, wherein the light-direction adjusting section comprises an absorbing section for absorbing a decomposition product which is generated by discharge at the electric contacts.

19. An electric contact apparatus comprising:

a pair of electric contacts;

an optical fiber which receives, from one end thereof, light generated at the opening and closing operation time, and guide the light to the other end of the optical fiber; and a processing section which detects abrasion of the electric contacts based on the characteristics of the light output from the other end of the optical fiber, wherein the optical fiber has characteristics which prevent transmission of ultraviolet rays, and the electric contacts comprise, a pair of first units provided on surfaces of end sides of the electric contacts, respectively, and emitting light having first characteristics at an opening and closing operation time at which the electric contacts are opened and closed; and a pair of second units covered with the first units, respectively, and emitting light having second characteristics which differ from the first characteristics, when abrasion of the first units reaches abrasion detection positions at the opening and closing operation time, wherein the abrasion of the first units is caused by an opening and closing operation of the electric contacts.

* * * * *